US006042526A

United States Patent [19]

Bäumer

[11] Patent Number: 6,042,526

[45] Date of Patent: Mar. 28, 2000

[54] METHOD OF AND APPARATUS FOR MAKING A BOTTOM OF A TUBULAR SECTION FOR FORMATION OF A BAG OR SACK

[75] Inventor: Josef Bäumer, Hopsten, Germany

[73] Assignee: B + B Maschinenbau GmbH, Hopsten, Germany

[21] Appl. No.: 09/081,578

[22] Filed: May 19, 1998

Related U.S. Application Data

[63] Continuation-in-part of application No. 08/492,730, Jun. 20, 1995, abandoned.

[51] Int. Cl.[7] ..... B31B 1/90

[52] U.S. Cl. ..... 493/218; 493/231; 493/243; 493/313; 493/936

[58] Field of Search ..... 493/218, 219, 493/212, 231, 243, 245, 255, 256, 259, 260, 262, 263, 313, 929, 936

[56] References Cited

U.S. PATENT DOCUMENTS

| | | | |
|---|---|---|---|
| 503,810 | 8/1893 | Stanley | 493/936 |
| 2,570,047 | 10/1951 | Burroughs | 493/936 |
| 3,927,606 | 12/1975 | Brockmuller et al. | 493/936 |
| 3,967,544 | 7/1976 | Brock et al. | 493/197 |
| 5,102,384 | 4/1992 | Ross et al. | 493/936 |
| 5,279,095 | 1/1994 | Muller | 493/313 |

*Primary Examiner*—Eugene L. Kim
*Attorney, Agent, or Firm*—Henry M. Feiereisen

[57] ABSTRACT

In a method and apparatus of making the bottom of a flat tubular section, a tubular section is transported by a conveyor at a continuous rate in an alignment transversely to a longitudinal direction of the conveyor, with a first suction unit partially opening one end of the tubular section. Subsequently, a spreader unit is inserted into the partially open end of the tubular section and moved in a first phase in a substantially linear horizontal motion toward an end position in which the spreading unit conforms to fold lines of a finished bag bottom. In a second phase, the spreader unit swings from a substantially horizontal alignment into a substantially vertical position about a horizontal pivot axis by way of a compound motion in which a movement of the spreading unit into the end position is superimposed by a movement into the vertical position, thereby forming the open bag bottom. Thereafter, the spreader unit is withdrawn from the bag bottom while maintaining the formed bag bottom in vertical disposition by means of a second suction unit for further processing.

9 Claims, 13 Drawing Sheets

METHOD OF AND APPARATUS FOR MAKING A BOTTOM OF A TUBULAR SECTION FOR FORMATION OF A BAG OR SACK

CROSS-REFERENCES TO RELATED APPLICATIONS

This application is a continuation-in-part of prior filed patent application Ser. No. 08/492,730, now abandoned filed Jun. 20, 1995.

BACKGROUND OF THE INVENTION

The present invention refers to a method of and apparatus for making a bottom of a tubular section for formation of a bag or sack.

In general, sacks or bags are made of flat tubular sections which are provided at their respect ends with serrations for defining the bottom edges. Subsequently, the ends for forming the bottom are partially opened by suction means, whereupon corner flaps are formed, and bottom score lines are introduced into the opened bottom for formation of parallel outer bottom edges so that the side bottom flaps are foldable along the score lines for closing the bottom. Bottoms of this type are referred to as cross bottoms or also block bottoms.

Conventionally, block bottom bags or block bottom sacks are made by so-called cylinder machines which are dimensioned in such a manner that the tubular sections are conveyed longitudinally in conveying direction, i.e. the longitudinal edges of the tubular sections extend in conveying direction. With machines of this type, block bottoms can be formed only on the leading ends of the tubular sections. In general, block bottom bags or block bottom sacks are made of paper. In particular in connection with block bottom sacks, several paper layers may be used, with the material layers of the folded bottom being joined together through gluing.

A particular advantage of block bottom bags or block bottom sacks is the precise parallelepiped or brick-shaped configuration of the bag when being filled, which is particularly advantageous for a subsequent stacking and palletizing. This configuration is accomplished however only when forming both ends of the bag or sack with such block bottoms. To date, a mechanized production is, however, not possible.

For that reason, so-called cross bottom valve sacks are widely used which differ from block bottom bags by their lack of side folds. Thus, a cross bottom bag will not assume a precise brick-shaped configuration when being filled. After opening the tubular section ends, a so-called open bottom is created, with the corner flaps being formed along the longitudinal edges. Cross bottom sacks have corner flaps describing a rectangular triangle, and the diagonal bottom edges extending to the bottom center at an angle of 45° intersect the longitudinal edge of the sack. In block bottom bags, the material layers of the side folds are positioned between both diagonal bottom edges so that the corner flaps are of trapezoid configuration. Due to the material layers of the side folds, the height of the open bottom in a block bottom is greater by twice the depth of the side folds than the height in cross bottoms.

As the formation of the open bottom is technically more complicated in the case of block bottoms, block bottom sacks or block bottom bags are transported longitudinally in conveying direction during production. The capacity of such a machine is significantly lower compared to a machine in which the bags are transported transversely to the conveying direction. The reason is that at same power the throughput rate of the tubular sections in a transport longitudinally in conveying direction is much greater because the length of the tubular sections is generally greatly exceeds the widths thereof.

Cross bottom sacks are made by machines in which the sacks are conveyed transversely to the conveying direction and the opening of the tube ends to form the open bottom is carried out by two opening tools which are rotatably driven in opposition to each other and rotate about vertical axes, or axes which are inclined relative to the vertical. The speed of the opening tools is irregular and is the greatest at the moment of entering the partially opened end. This technique has proven effective only in conjunction with making cross bottom sacks. In connection with making block bottom sacks, this technique is unsuitable because the opening tools retract prematurely from the ends of the tubular section, since, as stated above, the height of the open bottom in block bottoms is significantly greater than the height in cross bottoms. In block bottoms, the fraction of material being shaped is also much greater than in cross bottoms.

SUMMARY OF THE INVENTION

It is an object of the present invention to provide an improved method of and apparatus for making a bottom of a tubular section for formation of sacks or bags.

In particular, it is an object of the present invention to provide an improved method of making bags or sacks with cross bottom or block bottom, in particular sacks with at least one block bottom at a same output as reached in connection with cross bottom sacks, while yet allowing incorporation of a filling valve in form of a leaf or a tubing within a bottom.

These objects and others which will become apparent hereinafter are attained in accordance with the present invention by transporting a tubular section by a conveyor at a continuous rate in an alignment transversely to a longitudinal direction of the conveyor, partially opening one end of the tubular section by a first suction unit, inserting a spreader unit into the partially open end of the tubular section, swinging the spreader unit in a first phase in a substantially linear horizontal motion toward an end position in which the spreading unit conforms to fold lines of a finished bag bottom, moving the spreader unit in a second phase from a substantially horizontal alignment into a substantially vertical position about a horizontal axis by way of a compound motion in which a movement of the spreading unit into the end position is superimposed by a movement into the vertical position, thereby forming the open bag bottom, and withdrawing the spreader unit from the bag bottom while maintaining the formed open bag bottom in vertical disposition by means of a second suction unit for allowing further processing.

Such a method is suitable for making block bottoms. It enables an advantageous transport of the tubular sections transversely or crossways to the conveying direction by using a spreader unit in form of fingers which are so movable as to conform with fold lines of the tubular section and thereby enable an automatic folding to form the bag bottom in conjunction with suction units. It is possible to incorporate a filling valve in an open bottom so that the production is not limited to making open bags or sacks but encompasses also valve sacks or valve bags. The formed bags or sacks can easily be stacked and palletized.

Moreover, the use of the spreader unit results in the production of extremely precise bottoms. It is certainly possible to provide both ends of the tubular sections with block bottoms, with the formed sack being cut centrally by a section transversely to the longitudinal edges. This is particular important for making block bottom bags which can then be further modified into vacuum cleaner bags.

As the spreader unit operates in a vertical plane to form the bag bottom of the tubular section, the open bottom stands vertical and thus can be easily viewed during bottom formation. Since the spreader unit for opening the tubular section end has to move at a same speed as the tubular section, the spreader unit is actuated in the horizontal plane in the machine cycle at irregular speed.

According to another feature of the present invention, the tubular section is so conveyed in a gap between overlying conveyor belts that a transverse bottom edge is defined, with the horizontal pivot axis coinciding with the transverse bottom edge of the tubular section.

According to another feature of the present invention, the tubular section is advanced continuously by the conveyor unit in synchronism with an operation of the spreader unit.

A bag bottom formation apparatus in accordance with the present invention includes a conveyor unit for transporting a tubular section crossways at a continuous rate in conveying direction, a first suction unit for partially opening an end of the tubular section, a spreading unit insertable into said end of the tubular section during advance of the tubular section by the conveyor unit and moveable in a first phase in a substantially linear motion toward an end position in which the spreading unit conforms to fold lines of a finished bag bottom, and swingable in a second phase from a substantially horizontal alignment into a substantially vertical disposition about a horizontal axis by way of a compound motion in which a movement of the spreading unit into the end position is superimposed by a movement into the vertical position, thereby forming the open bag bottom, and a second suction unit maintaining the open bag bottom in the vertical disposition for further processing.

A bag bottom formation apparatus according to the present invention can be operated at great capacity and thus becomes highly cost-efficient.

Preferably, the spreader unit includes first and second pairs of fingers in symmetric superimposed disposition, with the fingers of each pair moving apart from one another in unison in a horizontal direction during the first phase and the pairs of fingers moving apart from one another in unison in opposite direction about the horizontal axis to occupy the vertical disposition, whereby the fingers of each pair bear with their inside upon diagonally extending bottom edges of the bag bottom.

According to another feature of the present invention, the first suction unit includes suction cups applying an underpressure from both sides of the tubular section to partially open the end of the tubular section, with the suction unit being so synchronized as to disengage from the tubular section when the spreader unit executes the compound motion.

According to still another feature of the present invention, the second suction unit includes two suction belts arranged above one another at formation of a gap which defines the horizontal pivot axis.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1A:
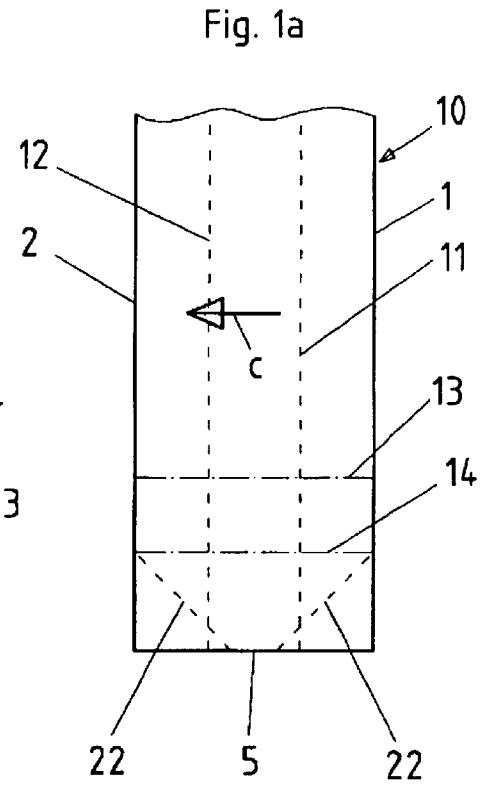
FIG. 1*a* is a top view of a typical tubular section for fabrication of a block bottom bag.

Throughout all the Figures, same or corresponding elements are generally indicated by same reference numerals.

Turning now to the drawing, and in particular to FIGS. 1*a* to 1*d*, there are shown successive stages for making a block bottom bag or block bottom sack (hereinafter referred to only as block bottom bag). Persons skilled in the art will understand that even though the following description makes reference only to the production of block bottom bags, the apparatus and method according to the present invention are equally applicable to make cross bottom bags.

Figure 1B:
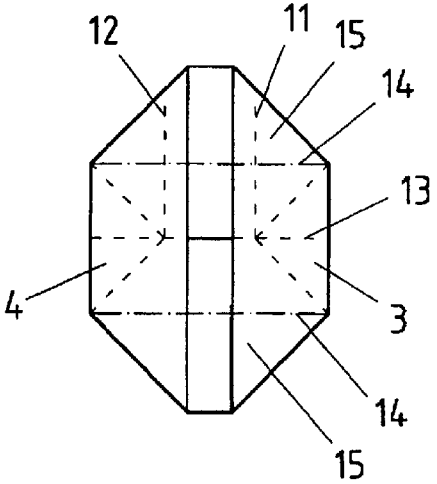
FIG. 1*b* is a frontal view of the tubular section, showing the formation of an open bag bottom after folding operation by an apparatus according to the present invention.
Figure 1C:
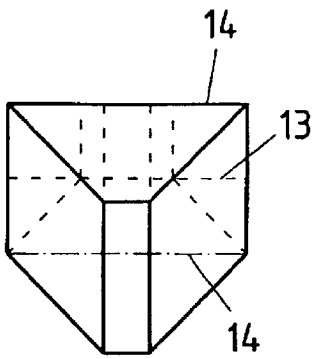
FIGS. 1*c* and 1*d* show further frontal views of processing steps for completing the bag bottom.
Figure 1D:
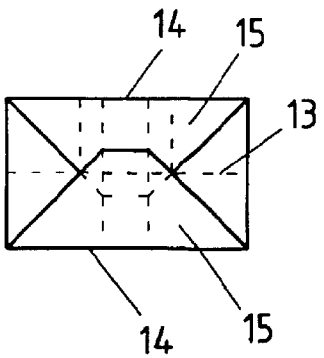

FIG. 1*a* shows a tubular section 10 which is placed on a conveyor transversely to the conveying direction as indicated by arrow C. For illustrative purposes, only one end of the tubular section 10 is depicted for making a block bottom. Persons skilled in the art will understand that the formation of a bottom at only one end results in an open bag while the formation of a block bottom on both ends allows production of a valve sack. A valve sack includes a valve through which the sack (or bag) can be filled via a respective filling pipe. The valve may be a pre-manufactured hose or a simple leaf which is shaped to a tubing during closing of the bottom, as shown in FIGS. 1*c* and 1*d* and described in more detail furtherbelow.

The tubular section 10, which can be made of one or several paper layers or of a plastic film, is provided with side folds 11, 12 extending inwardly from the outer longitudinal edges 1, 2. If the tubular section 10 is made of paper, one or more paper webs are shaped to form a tube joined by a longitudinal bonding seam which is not shown in the drawings for sake of simplicity.

In order to facilitate a folding of the rectangular block bottom, two parallel fold lines 13, 14 are provided which extend across the tubular section 10 without intersecting the side folds 11, 12. The fold lines 13, 14 may be formed by scoring the tubular section 10 through a suitable serration tool. However, as will be described furtherbelow, the provision of such fold lines is not required and can be omitted, but is shown for better understanding. The tubular section 10 is further provided with fold lines 22 which extend at an angle of 45° to the longitudinal edges 1, 2 and constitute the diagonal bottom edges.

As shown in FIG. 1*a*, the distance of the inner fold line 13 from the outer fold line 14 corresponds exactly to the depth of the side folds 11, 12, and the outer fold line 14 is positioned at a distance to the edge 5 of the tubular section 10 which distance is greater that the distance of the fold line 14 from the inner fold line 13 and the depth of the side folds 11, 12.

As stated above, the flat tubular section 10, as shown in FIG. 1*a*, is continuously advanced in conveying direction C by a suitable conveyor. While continuously advanced, the tubular section 10 is acted upon by a suction unit 18, 19 (FIG. 2) for separating the superimposed layer ends of the tubular section 10 to such a degree that a spreader unit, generally designated by reference numeral 200 can fold the bag bottom to assume a formation as shown in FIG. 1*b* in which the bottom extends perpendiculary to the main body of the tubular section 10, with the corner flaps 3, 4 being automatically inwardly folded and the bottom flaps 15 extending perpendicular to the tubular section 10, i.e. perpendicular to the plane of projection. The suction unit 18, 19 is so synchronized with the spreader unit 200 as not to interfere with the motions executed by the spreader unit 200.

Subsequently, the bottom flaps 15 are folded along the outer fold lines 14, as shown in FIGS. 1*c* and 1*d*. As stated previously, the fold lines 13, 14 are shown for illustrative purposes only and may be omitted altogether because the formation of the bottom is executed automatically and precisely by the spreader unit 200 which moves into the interior of the tubular section end 10 to form the bottom from the inside.

In case both ends of the tubular section 10 are formed with an open bottom to produce a valve sack, a valve in the form of a hose or a leaf may be placed in the open bottom, shown in the configuration of FIG. 1*b*. It is however also possible to place a so-called inner lock in form of a leaf in the open bottom in order to increase its tightness.

Figure 2:
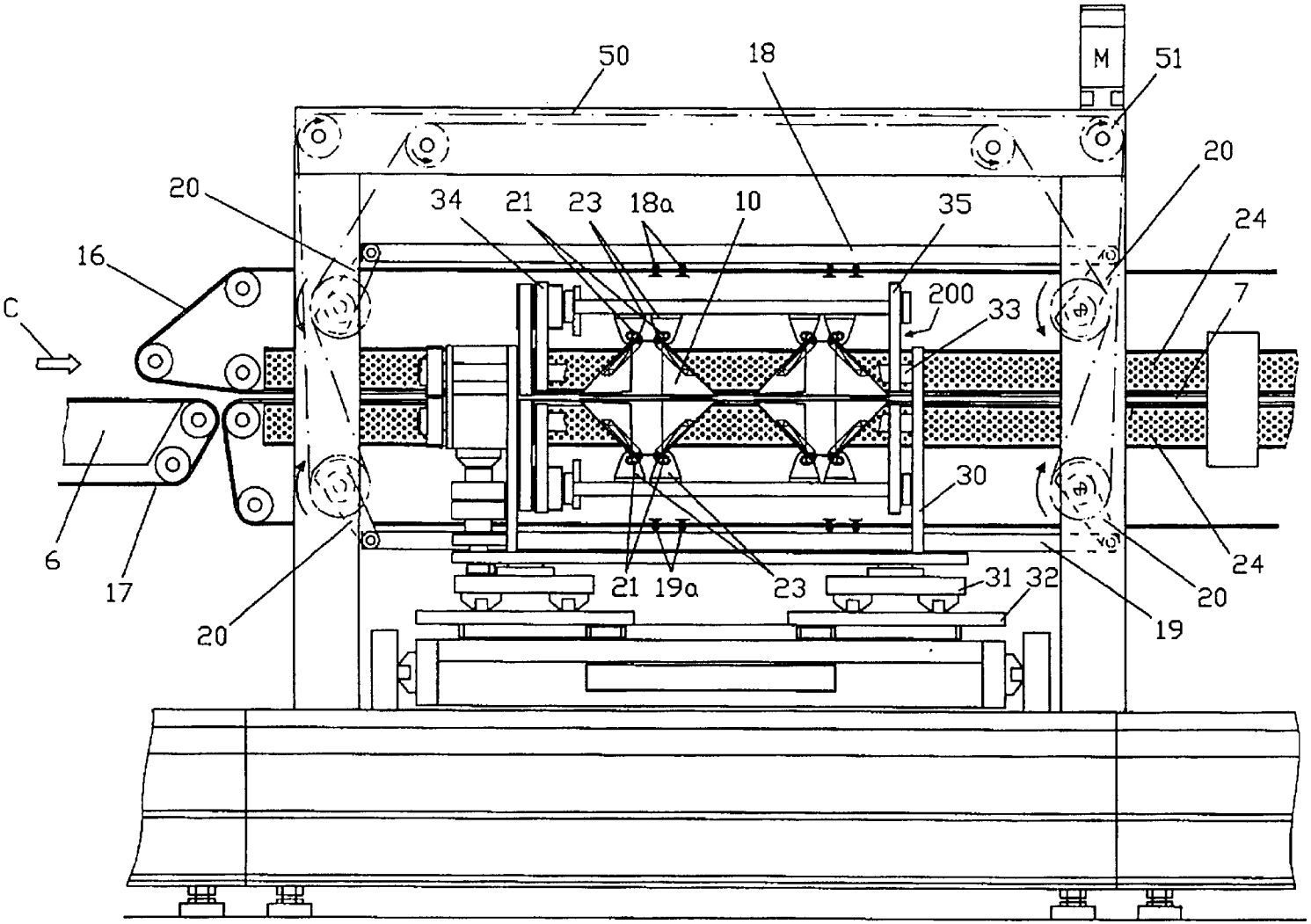
FIG. 2 is a schematic, simplified side view of one embodiment of an apparatus for carrying out the method steps as illustrated in FIGS. 1*a* to 1*d;*

Turning now to FIG. 2, there is shown a schematic, simplified side view of one embodiment of a bottom forming apparatus, generally designated by reference numeral 100 for carrying out the method steps as illustrated in FIGS. 1*a* to 1*d*. A tubular section 10 in the configuration shown in FIG. 1*a* is advanced in conveying direction C crossways by a suitable conveyor 6 and transported to a subsequent conveyor in the form of two spaced-apart upper belts 16 and two pertaining lower belts 17, with the tubular section 10 being positioned in a gap 7 between the upper and lower belts 16, 17 such that the fold line 13 of the tubular section 10 is positioned in the gap 4 to define a pivot axis about which the bottom to be formed is subsequently pivoted by the spreader unit 200.

Figure 3:
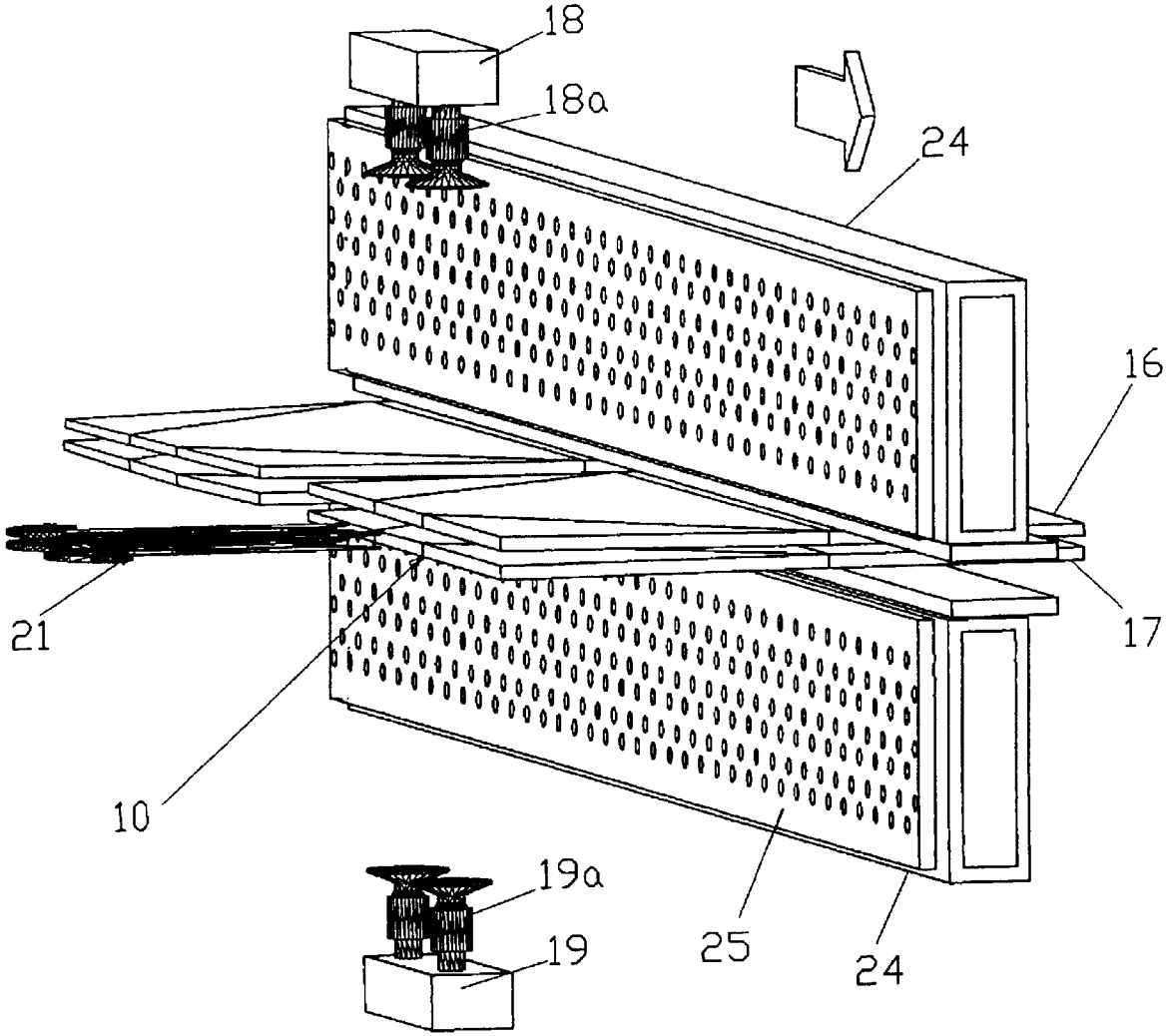
FIG. 3 is a schematic fragmentary perspective illustration of the bag bottom formation apparatus, shown in detail the suction units together with the spreader unit and conveyor belts.

Extending parallel to the conveyor belts 16, 17 is a first suction unit in the form of two superimposed suction boxes 24 which are spaced from one another to form a gap in alignment with gap 4 between the belts 16, 17 for passage of the tubular section 10, as best seen in FIG. 3. Thus, the main body of the tubular section 10 is positioned in the projection of FIG. 2 behind the suction boxes 24 while the bottom to be formed is positioned in front of the suction boxes 24 for subsequent pivoting about the pivot axis defined by the gap 4. As will be described furtherbelow, the suction boxes 24 apply a suction force in a horizontal direction that is perpendicular to the conveying direction C and include a suction box conveyor 25.

The superimposed ends of the tubular sections 10 are partially moved apart by a second suction unit in the form of upper and lower suction pipes 18, 19 which are articulated at their axial ends to respective cranks 20 of which at least one is driven to rotate the suction pipes 18, 19. This can be done in a conventional manner by a suitable synchronous belt drive, generally designated by reference numeral 50, with a drive M being operatively connected to a pulley, e.g. pulley 51. The suction pipes 18, 19 are each formed with suction cups 18*a*, 19*a* to separate the ends to such a degree that the spreader unit 200 is enabled to enter the tubular section 10 for shaping the bottom into a configuration shown in FIG. 1*b*, representing the open bottom. The spreader unit 200 includes a frame structure 30 which is supported on carriages 31 for mobility along a suitably curved track 32 during advance of the tubular section 10 so as to allow entrance into and retraction from the tubular section 10 during bottom formation in synchronism with the operation of the suction pipes 18, 19.

The spreader unit 200 includes two neighboring groups of fingers 21 which are mounted to the frame structure 30, with each group having two pairs of fingers 21 in opposite disposition. The fingers 21 are driven by an actuating mechanism 23 for pivoting the fingers 21 about the horizontal pivot axis which coincides with the inner fold line 13 and so configured as to move in a position coinciding with the diagonal bottom edges 22. The actuating mechanism 23 includes a shaft 33 which acts on the frame structure 30 via a belt drive 34 and a lever 35.

The apparatus 100 of FIG. 2 has thus a total of eight fingers to allow simultaneous formation of two bag bottoms and to thereby effect an increase the output. As the two groups of two pairs of superimposed fingers 21 are of an identical construction, hence only one group of two pairs of fingers 21 will hereinafter be described in detail.

The operation of the bag bottom formation apparatus 100 according to the present invention will now be described in more detail with reference to FIGS. 4*a* to 4*e*.

Figure 4A:
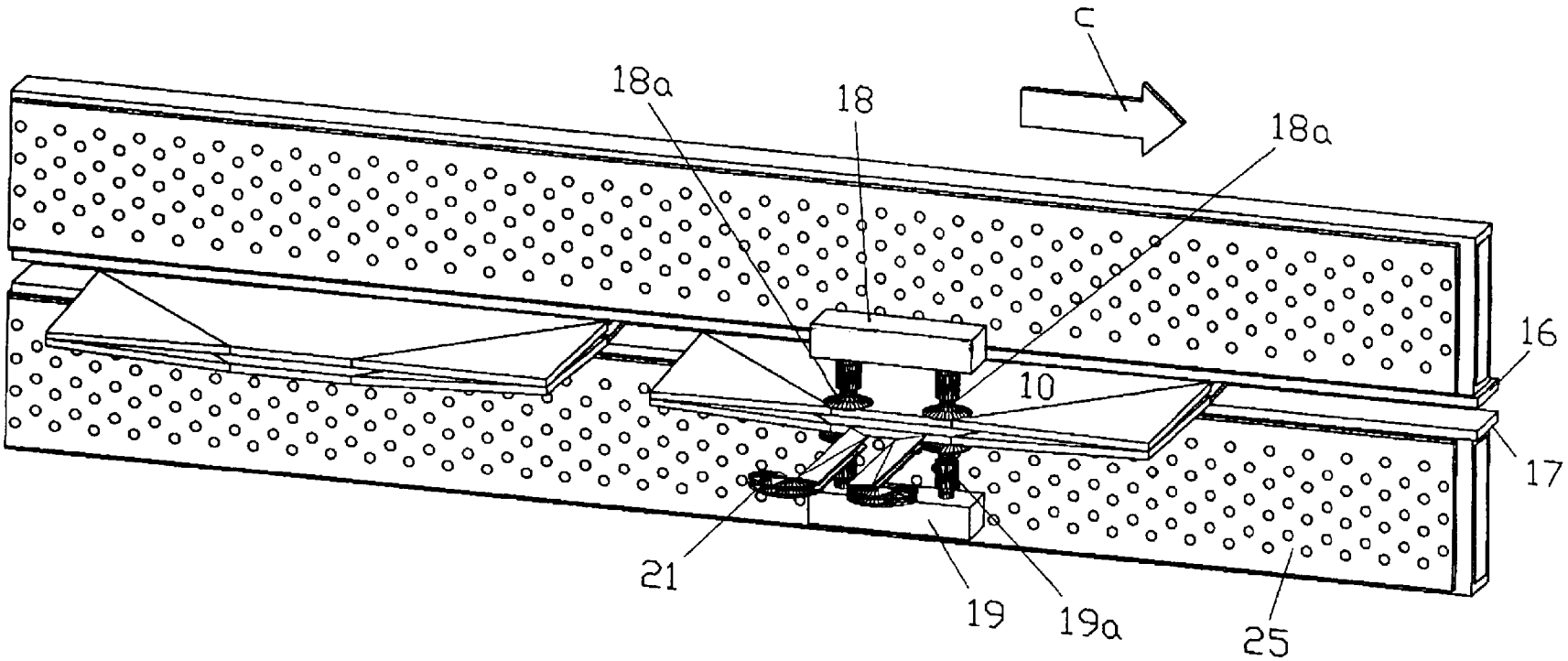
FIGS. 4*a* to 4*e* show schematic, simplified perspective views of various stages of the bag bottom formation apparatus according to the present invention to carry out the steps shown in FIGS. 1*a* to 1*d*.
Figure 4B:
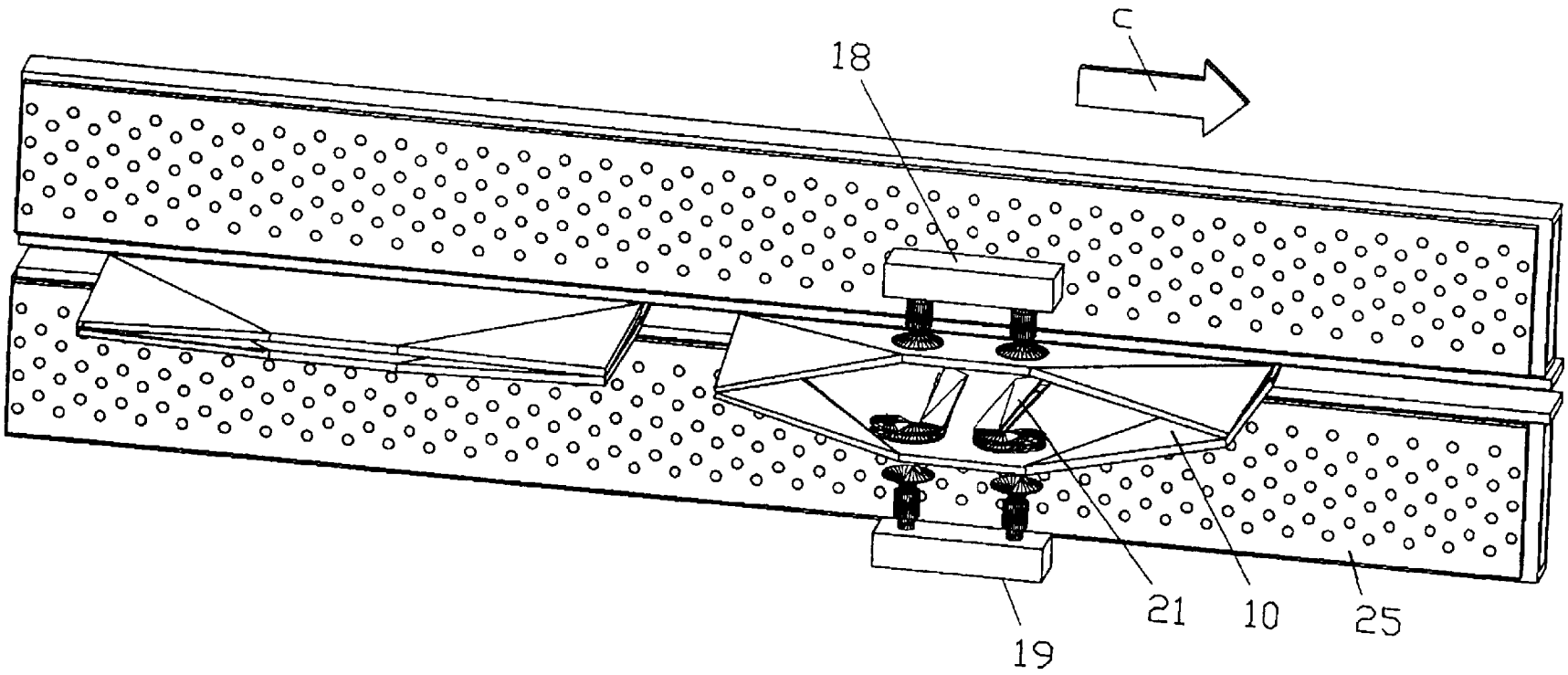
Figure 4C:
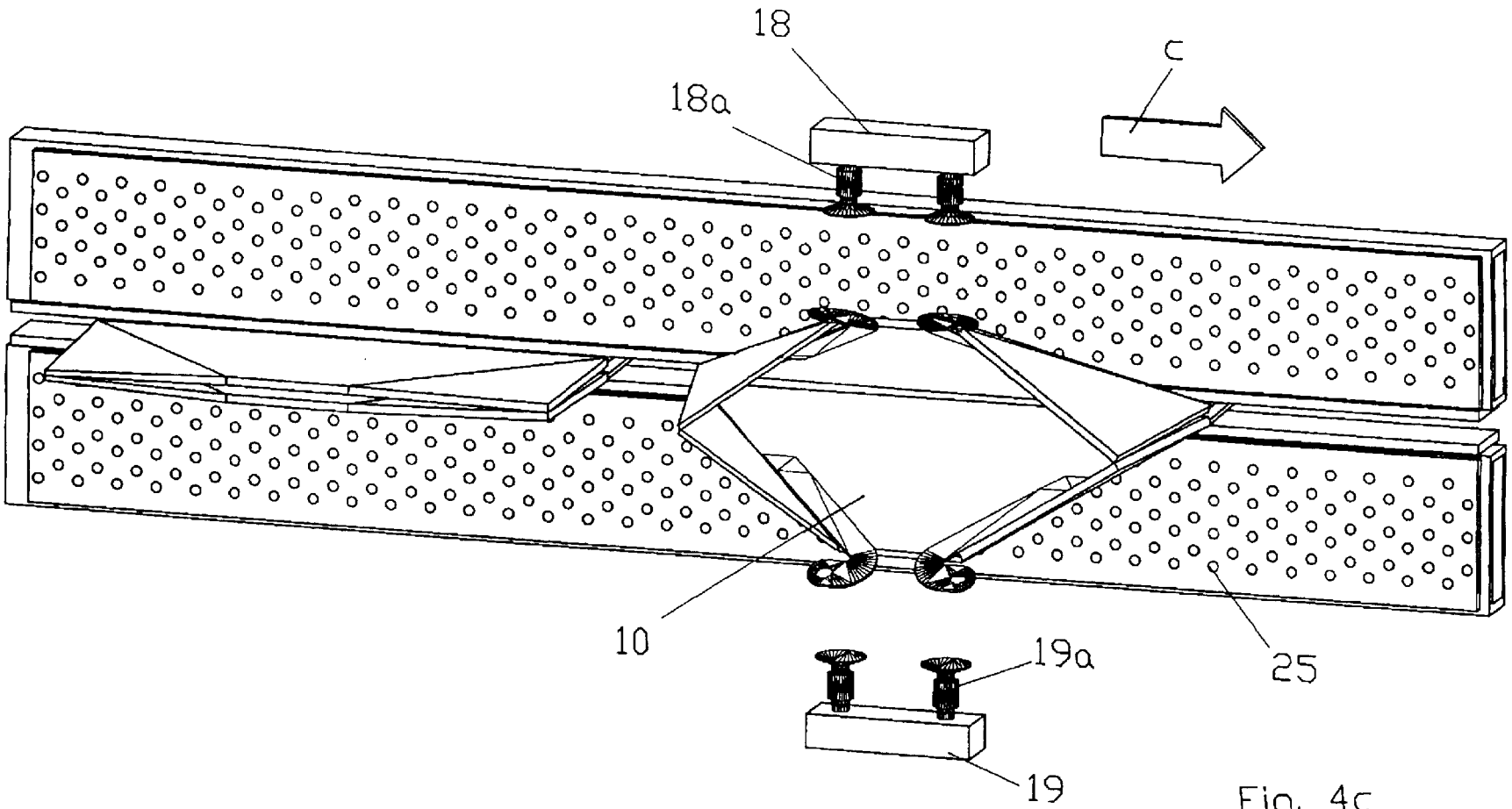

The travel path of the fingers 21 along the track 32 is synchronized to the movement pattern of the suction cups 18*a*, 19*a* during continuous advance of the tubular section 10 such that in an initial phase the suction cups 18*a*, 19*a* are lowered from an idle position shown in FIG. 4*a* onto the advancing tubular section 10 to slightly move apart the superimposed layer ends 10*a*, 10*b* of the tubular section 10, as shown schematically in FIGS. 4*b* for allowing a subsequent entry of the four fingers 21 into the tubular section 10, with the two pairs of fingers 21 still being aligned in a horizontal superimposed disposition. During continuous advance of the tubular section 10, the opposing pairs of fingers 21 move in a first phase in a linear direction away from each other in horizontal direction, as shown in FIG. 4*c*, in direction toward an end position in which the fingers 21 conform to the fold lines 22 of a finished bag bottom to shape the bottom into a configuration, shown in FIG. 1*b* and indicated in FIG. 2 by dash-dot lines, while the suction cups 18*a*, 19*a* are retracted again so as not to interfere with the subsequent spreading operation.

Figure 4D:
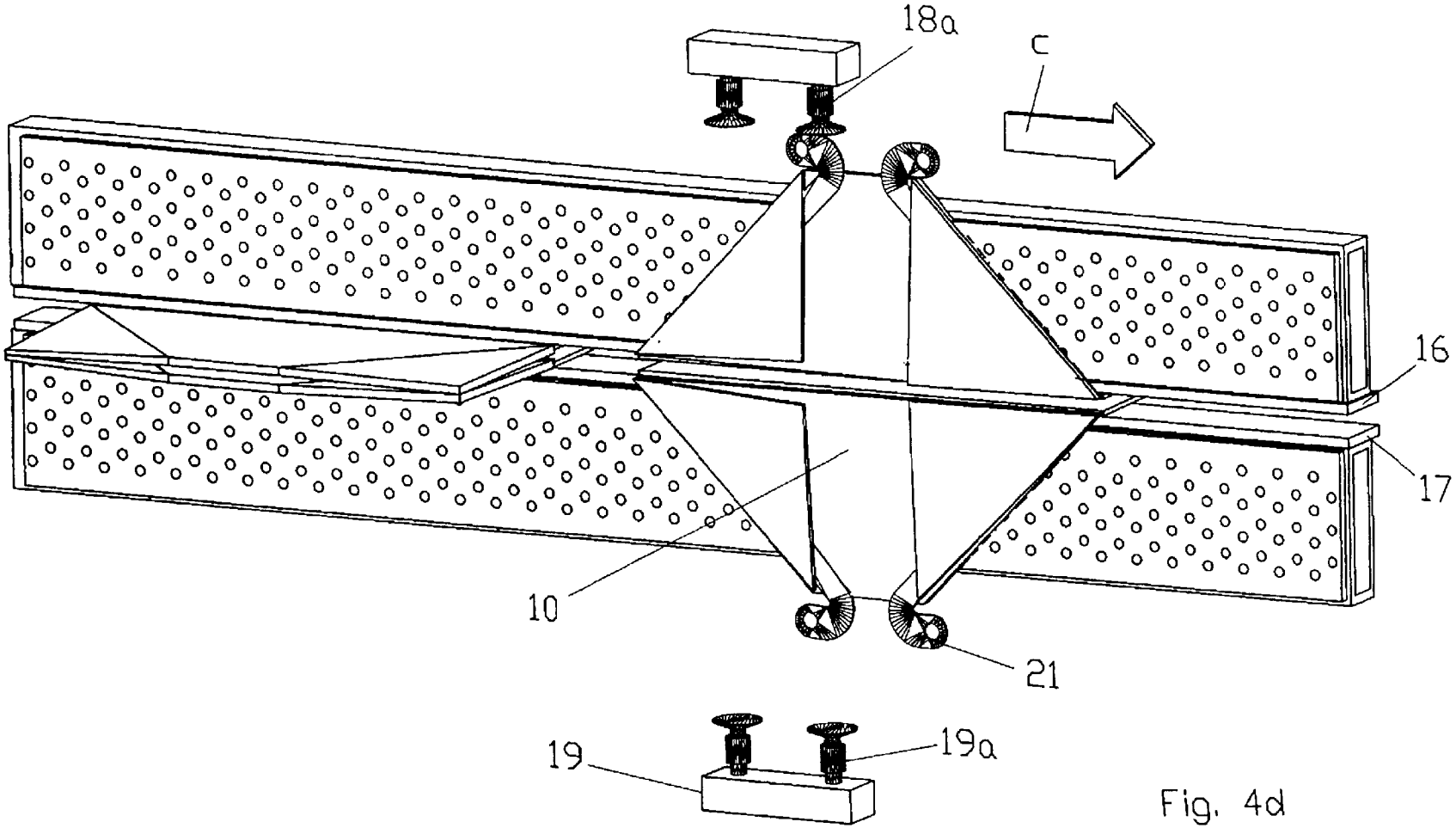
Figure 4E:
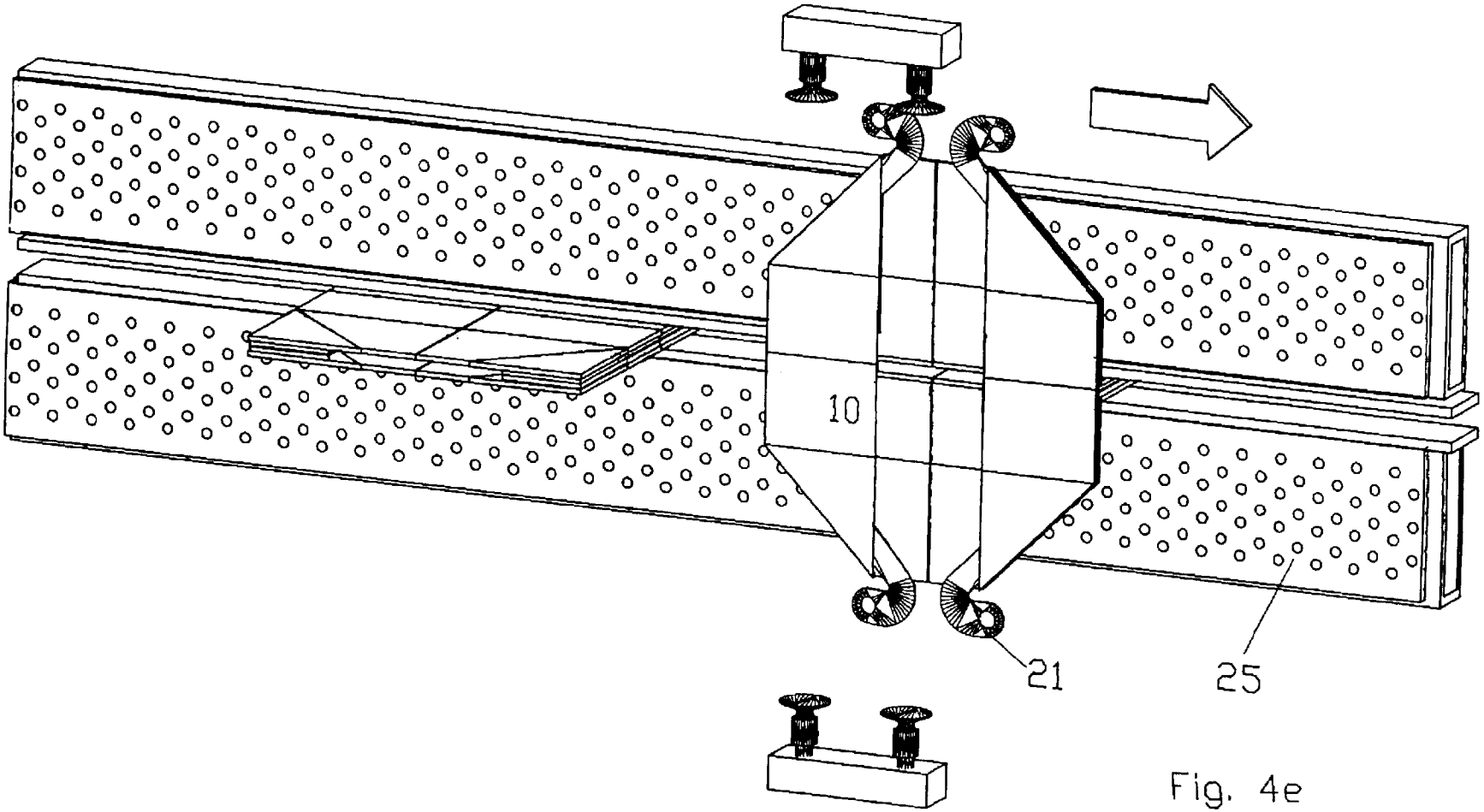

As the fingers 21 approach the end position, the superimposed pairs of fingers 21 execute a compound motion, i.e. travel along a substantially arcuate path as the fingers 21 of the lower and upper pairs move further apart in horizontal direction while the upper finger pair and the lower finger pair pivot about the pivot axis (fold line) 13 in opposite directions, as shown in FIG. 4*d*. Once the fingers 21 reach their end position, the vertical swinging motion about the pivot axis is effected without any relative movement between the fingers 21 and the tubular section 10 until the bag bottom is formed as shown in FIG. 4*e*, whereby the crossing points of the fold lines 14 and the fold lines 22 (see FIG. 1*a*) represent fixed points at which the respective ends of the fingers 21 are positioned when reaching the end position and moving into the vertical disposition. Thus, the distance of the finger tips to the horizontal pivot axis 13 remains constant, i.e. the finger 13 are stationary so that the bottom can be formed in an extremely precise manner with exactly shaped corners.

Since the fingers 21 are dimensioned in conformity to the configuration of the open bottom, and the bag bottom is formed from inside, an extremely precise bag bottom can thus be created, regardless as to whether a block bottom or a cross bottom is being made.

When the bag bottom is formed, as shown in FIG. 4*e*, the spreader unit 200 of two pairs of superimposed fingers 21 returns to its original position, by first moving the fingers 21 of each pair in the vertical disposition toward one another and then pivoting the pairs of fingers about the horizontal pivot axis toward one another into the horizontal disposition. During withdrawal of the spreader unit 200, the suction box conveyors 25 of the suction boxes 24 are operated to prevent the formed open bag bottom from collapsing during further advance and allowing subsequent folding of the bottom flaps 15 inwardly, e.g. by respectively curved bars or profiled sheets (not shown), in a manner as shown in FIGS. 1*c* and 1*d*.

Persons skilled in the art will understand that the movement path of the fingers 21 may certainly be modified in such a manner that in the first phase the fingers are moved horizontally until reaching the end position before swinging into the vertical disposition in the second phase. For reasons of efficiency, the movement path, as described initially, is however preferred.

Turning now to FIGS. 5*a* to 5*d*, there is shown another embodiment of a bottom forming apparatus according to the present invention, generally designated by reference numeral 200, for forming a partially open bottom as precursor for block bottoms or other bag configurations such as e.g. square bags. In describing the bottom forming apparatus 200, like parts will be identified by corresponding reference numerals succeeded by a "0".

Figure 5A:
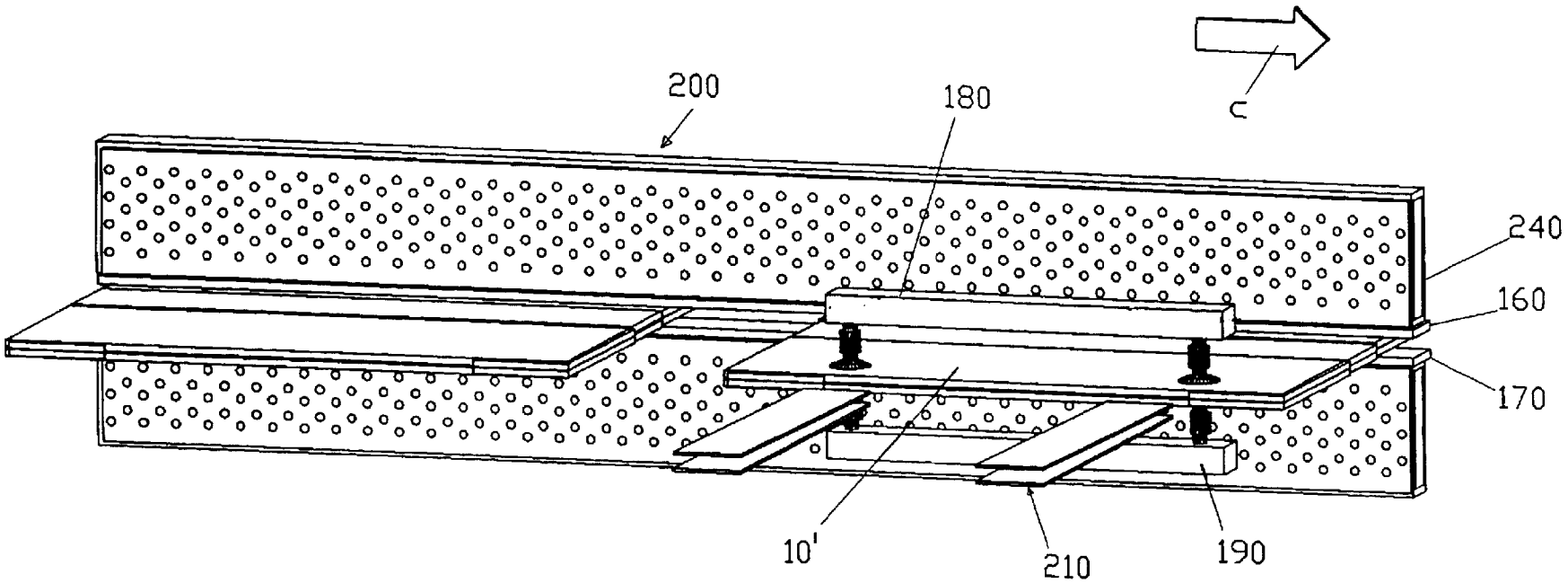
FIGS. 5*a* to 5*d* show schematic, simplified perspective views of various stages of another bag bottom formation apparatus according to the present invention for making a square bottom.
Figure 5B:
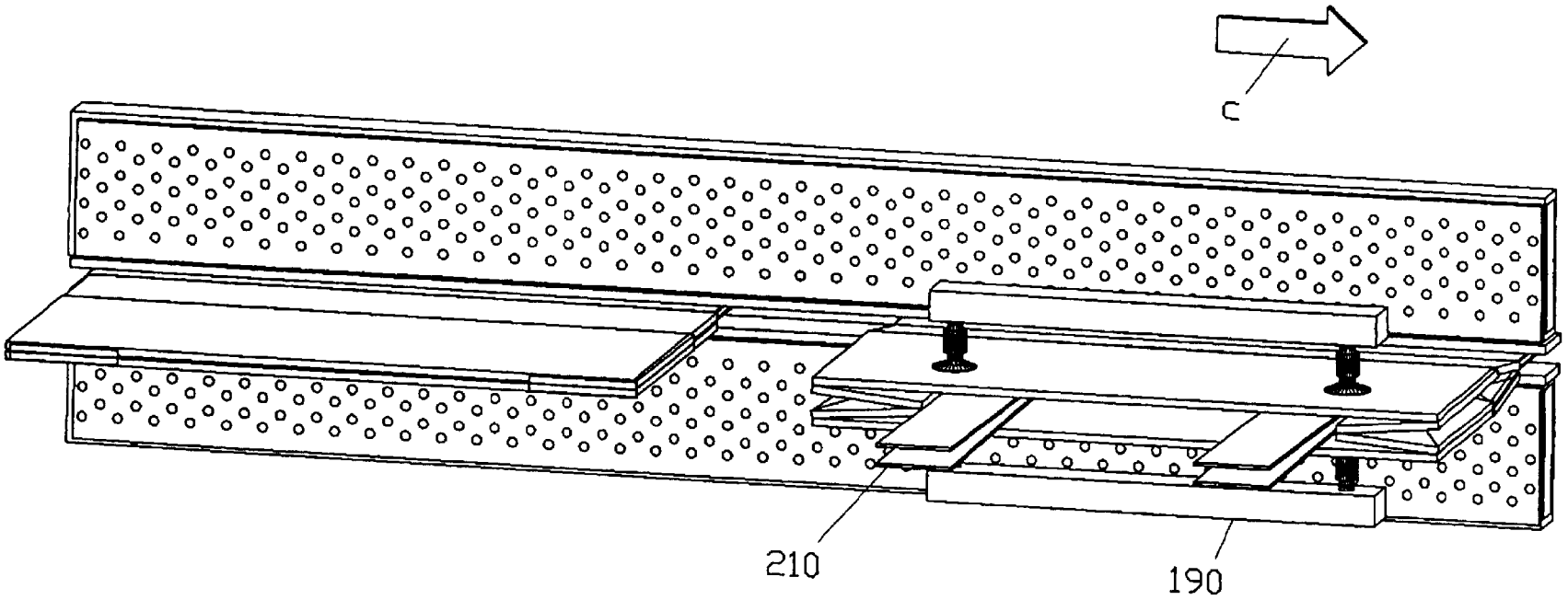
Figure 5C:
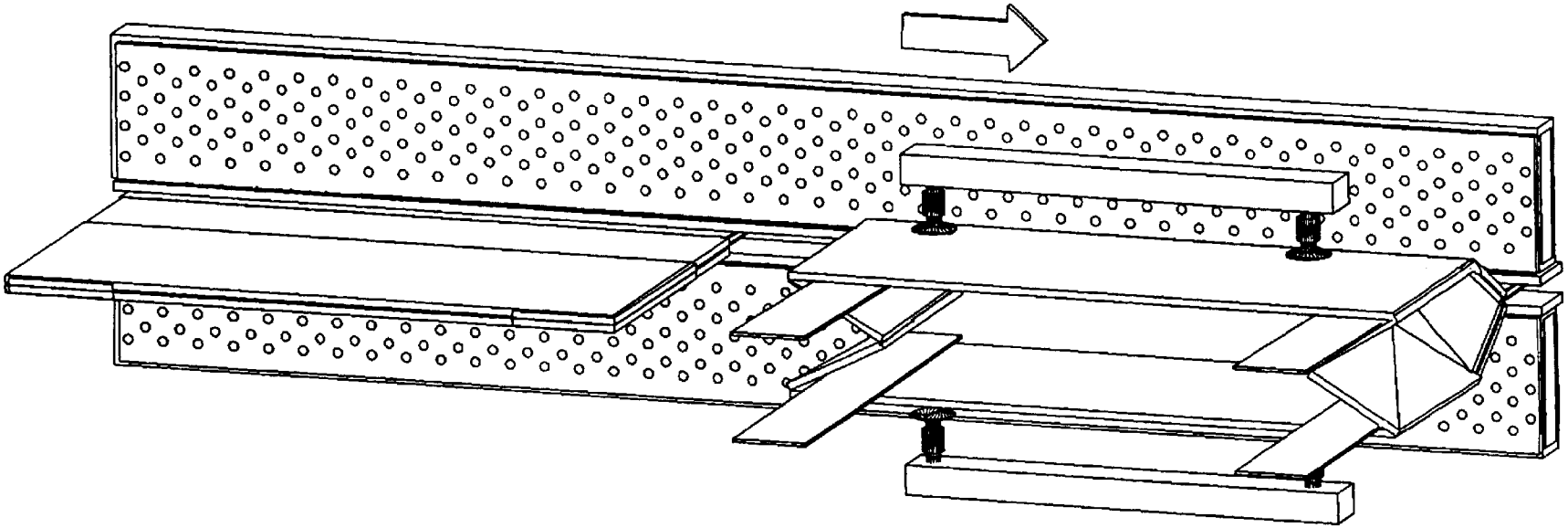
Figure 5D:
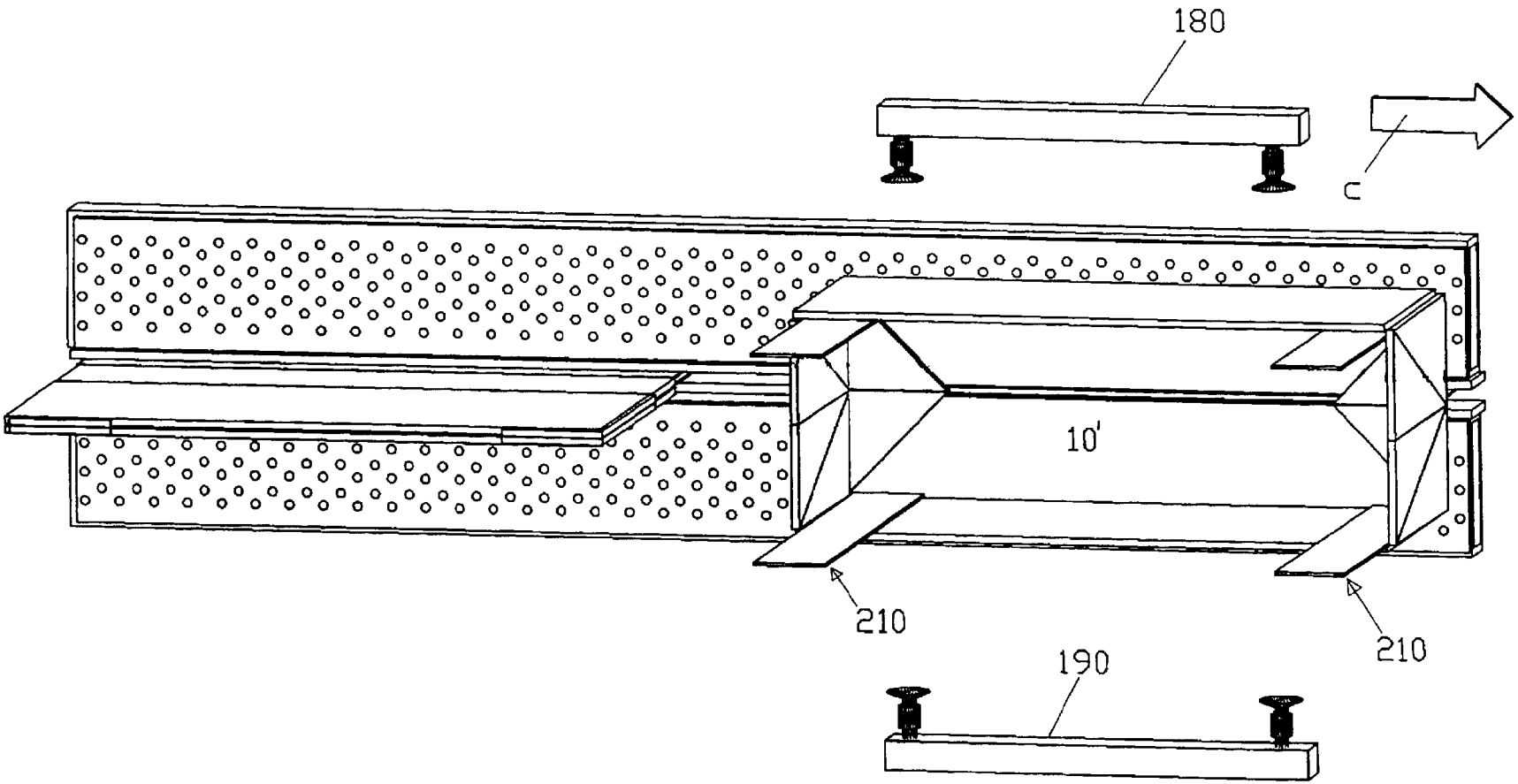
Figure 6A:
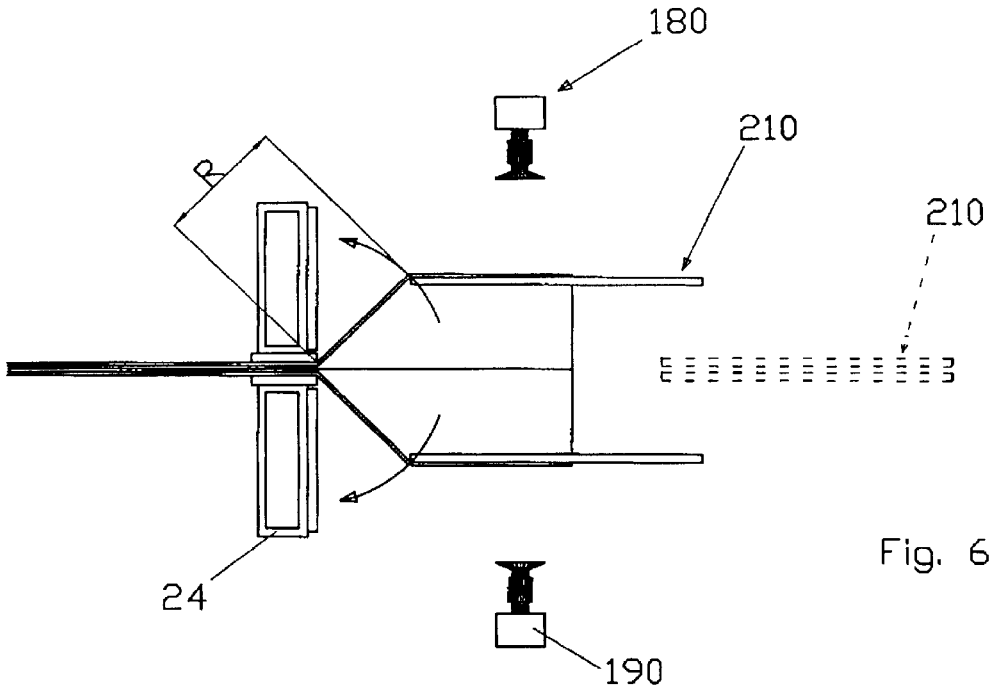
FIGS. 6*a* and 6*b* show further schematic illustrations of the bag bottom formation apparatus of FIGS. 5*a* to 5*d.*
Figure 6B:
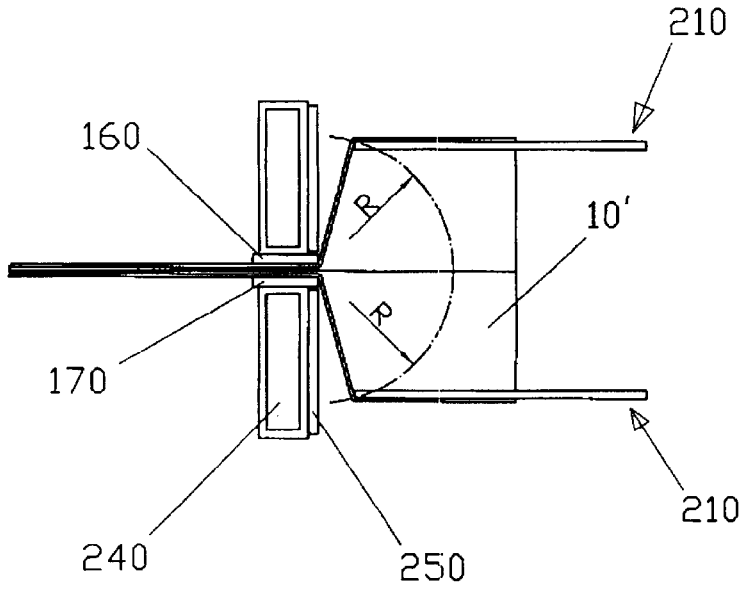

The bottom forming apparatus 200 include two pairs of superimposed fingers 210 which are of substantially plate-shaped configuration. The travel path of the fingers 210 is synchronized to the movement pattern of the suction units 180, 190 during continuous advance of a tubular section 10' such that in an initial phase the suction units 180, 190 are lowered from an idle position shown in FIG. 5*a* onto the advancing tubular section 10' to slightly move apart the superimposed layer ends of the tubular section 10' and to allow entrance of the fingers 210, as shown schematically in FIGS. 5*b*. During continuous advance of the tubular section 10', the opposing pairs of fingers 210 move sideways away from one another until coinciding with the fold lines, and at the same time travel translationally up and down, respectively, as shown in FIGS. 5*c* and 5*d*, whereby the fingers 210 describe a circular arc with same radius R about the pivot axis 13, as shown in FIGS. 6*a* and 6*b*, to form the square bottom, as shown in FIG. 5*d*.

It will be understood by persons skilled in the art that the movement of the fingers 210 may also be so controlled as to execute in a first phase a sideway motion to the end position in which the fingers 210 coincide with the fold lines before carrying out a translational motion.

Persons skilled in the art will understand that a bag forming apparatus according to the present invention may also be operated intermittently, i.e. at irregular speed.

While the invention has been illustrated and described as embodied in a method of and apparatus for making a bottom of a tubular section for formation of a bag or sack, it is not intended to be limited to the details shown since various modifications and structural changes may be made without departing in any way from the spirit of the present invention.

What is claimed as new and desired to be protected by Letters Patent is set forth in the appended claims.

I claims:

1. A method of making the bottom of a flat tubular section; comprising the steps of:

transporting a tubular section by a conveyor in an alignment transversely to a longitudinal direction of the conveyor;

partially opening one end of the tubular section by a first suction unit;

inserting one set of fingers into the partially open end of the tubular section;

moving the one set of fingers in a first phase in a substantially linear horizontal motion toward an end position in which the spreading unit conforms to fold lines of a finished bag bottom;

swinging the one set of fingers in a second phase from a substantially horizontal alignment into a substantially vertical position about a horizontal pivot axis by way of a compound motion in which a movement of the one set of fingers into the end position is superimposed by a movement into the vertical position, thereby forming the open bag bottom; and withdrawing the one set of fingers from the bag bottom while maintaining the formed bag bottom in vertical disposition by means of a second suction unit for further processing.

2. The method of claim 1 wherein the conveyor is driven at a continuous rate.

3. The method of claim 1 wherein the transporting step includes conveying the tubular section in a gap between overlying conveyor belts that a transverse bottom edge is defined, with the horizontal pivot axis substantially coinciding with the transverse bottom edge of the tubular section.

4. The method of claim 1 wherein the tubular section is advanced continuously by the conveyor unit in synchronism with the one set of fingers and the first and second suction units.

5. Apparatus for making the bottom of a flat tubular section; comprising:

a conveyor unit for transporting a tubular section crossways in conveying direction;

a first suction unit for partially opening an end of the tubular section;

a set of fingers insertable into said end of the tubular section during advance of the tubular section by the conveyor unit and movable in a first phase in a substantially linear motion toward an end position in which the set of fingers conforms to fold lines of a finished bag bottom, and in a second phase from a substantially horizontal alignment into a substantially vertical disposition about a horizontal axis by way of a compound motion in which a movement of the set of fingers into the end position is superimposed by a movement into the vertical position, thereby forming the open bag bottom; and a second suction unit maintaining the formed bag bottom in the vertical disposition for further processing.

6. The apparatus of claim 5 wherein the set of fingers includes first and second pairs of fingers in symmetric superimposed disposition, with the fingers of each pair moving apart from one another in unison in a horizontal direction during the first phase and the pairs of fingers moving apart from one another in unison in opposite direction during the second phase.

7. The apparatus of claim 6 wherein the fingers of each pair of fingers are so moved as to bear with their inside upon diagonally extending bottom edges of the bag bottom.

8. The apparatus of claim 5 wherein the first suction unit includes suction cups applying an underpressure on both sides of the tubular section to partially open the end of the tubular section, said first suction unit being so controlled as to disengage from the tubular section when the set of fingers executes the compound motion.

9. The apparatus of claim 5 wherein the second suction unit includes two suction boxes arranged above one another at formation of a gap which defines the horizontal pivot axis.

* * * * *